US006565027B2

(12) United States Patent
Antensteiner et al.

(10) Patent No.: US 6,565,027 B2
(45) Date of Patent: May 20, 2003

(54) REFINER

(75) Inventors: Peter Antensteiner, Steyr (AT); Helmuth Gabl, Graz (AT); Gerald Schadler, Vasoldsberg (AT); Walter Writzl, Graz (AT)

(73) Assignee: Andritz AG, Graz (AT)

( * ) Notice: Subject to any disclaimer, the term of this patent is extended or adjusted under 35 U.S.C. 154(b) by 0 days.

(21) Appl. No.: 09/775,997

(22) Filed: Feb. 2, 2001

(65) Prior Publication Data

US 2001/0022329 A1 Sep. 20, 2001

(30) Foreign Application Priority Data

Feb. 3, 2000 (AT) ..... 164/2000

(51) Int. Cl.[7] ..... B02C 19/00
(52) U.S. Cl. ..... 241/259.1; 241/261.1
(58) Field of Search ..... 241/259.1, 259.3, 241/261.1, 37

(56) References Cited

U.S. PATENT DOCUMENTS

| | | | | | |
|---|---|---|---|---|---|
| 2,207,931 | A | | 7/1940 | Morden | 92/27 |
| 3,754,716 | A | * | 8/1973 | Webster | 241/208 |
| 3,926,380 | A | * | 12/1975 | Musgrove et al. | 241/248 |
| 5,148,994 | A | * | 9/1992 | Haider et al. | 241/261.1 |
| 5,520,344 | A | * | 5/1996 | Fey et al. | 241/259.1 |
| 5,836,528 | A | * | 11/1998 | Hilgarth | 144/172 |

OTHER PUBLICATIONS

EPO Search Report EP 1 122 357 A3, dated Oct. 8, 2001.

* cited by examiner

*Primary Examiner*—John M. Husar
(74) *Attorney, Agent, or Firm*—Alix, Yale & Ristas, LLP

(57) ABSTRACT

A refiner for shredding pulps having refining surfaces provided on a rotor and a stator and which form a cylindrical or a conical refining gap. The refining gap is set by wedges which are mounted on the stator and rotor and can be moved against each other.

11 Claims, 10 Drawing Sheets

REFINER

BACKGROUND OF THE INVENTION

This invention relates generally to refining apparatus. More particularly, the present invention relates to apparatus for shredding pulps.

Nowadays most of the refiners built are of twin disc design. The disadvantages of the twin disc refiner are the changing relative speed along the length of the refining zone, a relatively high idle running rating and problems with centering the rotor, particularly at low throughputs. Conical refiners are also used, whose most significant disadvantages are the poor pumping effect. This leads to throughput difficulties and, as a result, the need to enlarge the grooves in the refining zones, which reduces the edge length. The relative displacement of the knives when being set in relation to one another, the need for a sturdy design as a result of the bearing forces occurring, and the difficulties in changing the refiner plates can be considered further disadvantages.

Another type of refiner known is the so called cylindrical refiner, as described in U.S. Pat. No. 5,813,618, for example. With this type of refiner, some of the disadvantages mentioned can be avoided, however it is important to ensure that the knives are set evenly in order to guarantee the same gap and thus, the same refining conditions over the entire circumference and along the lengths of the axial refining zones.

SUMMARY OF THE INVENTION

The refiner according to the invention is thus characterized by the refining gap being set by wedges which are mounted on the stator and rotor and can be moved against each other. This causes an axial movement, of the same dimension over the entire circumference, to be converted into a corresponding radial movement. This principle guarantees that the knives have exactly the same setting.

An advantageous further development of the invention is characterized by an axially movable wedge carrier being provided.

A favorable further development of the invention is characterized by a radially movable wedge carrier being provided. This wedge carrier permits the corresponding axial movement to be converted into a radial movement, thus allowing the refining gap to be set exactly.

A favorable configuration of the invention is characterized by the gap being continuously adjustable between 0 and 2 mm, preferably between 0 and 1 mm, for example between 0 and 0.5 mm. Thus the refining gap can always be set in an optimum way to suit the properties of the pulp suspension.

An advantageous configuration of the invention is characterized by the gap being suitable for setting up to 15 mm. Thus, it is possible to avoid any damage to the refiner plates, also during start-up operations or if larger particles suddenly appear.

A favorable further development of the invention is characterized by the relative speed at the periphery being 15–35 m/sec., preferably 20–30 m/sec.

A favorable configuration of the invention is characterized by the rotor speed being between 400 and 1,800 rpm, preferably between 500 and 1,000 rpm.

An advantageous further development of a refiner with twin rotor according to the invention is characterized by two wedges being provided at the axially movable wedge carrier and whose inclined surfaces slide over the corresponding surfaces of the radially adjustable wedge carrier.

An advantageous configuration of the invention is characterized by the radially movable wedge carrier being divided into segments of a circle.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
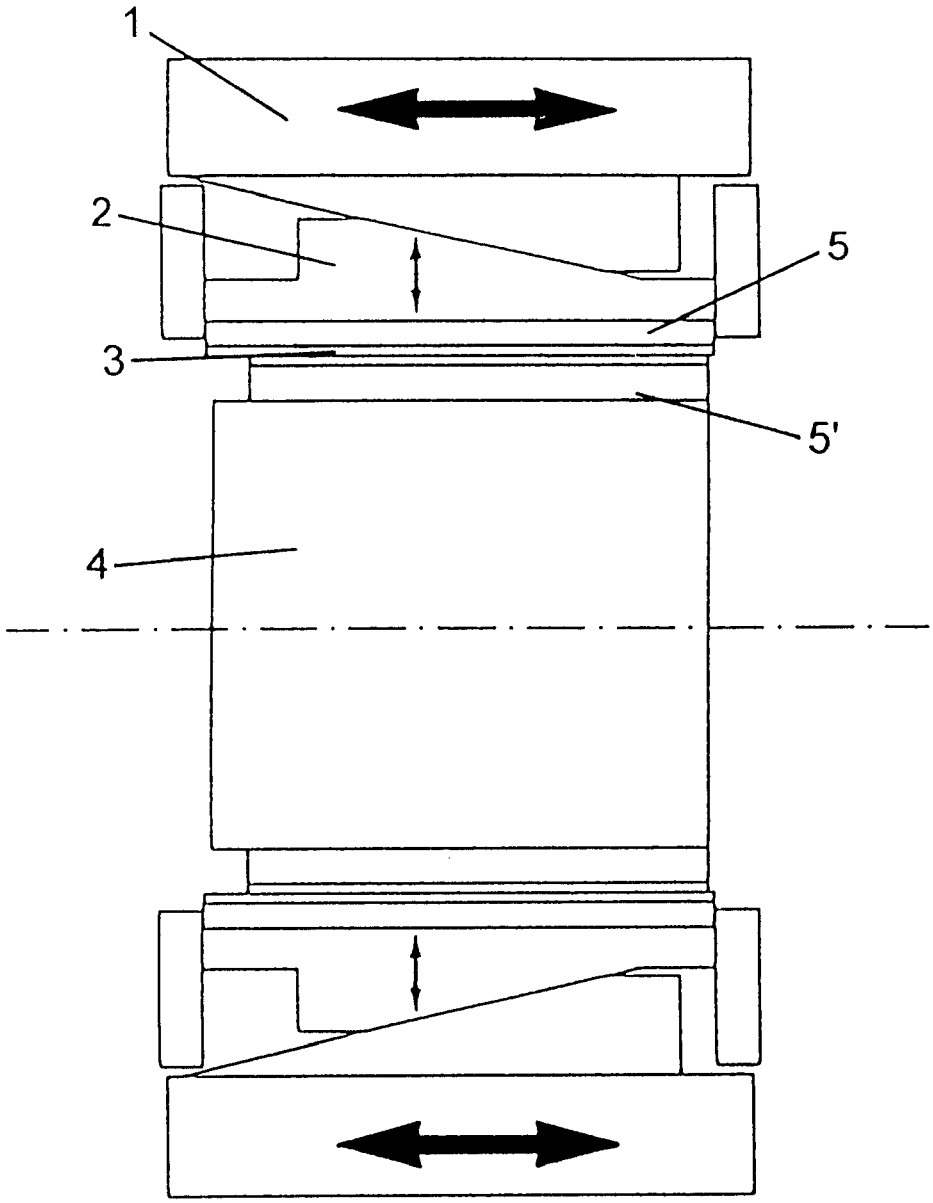
FIG. 1 is a schematic view of a first embodiment of the refiner of the invention.

FIG. 1 shows a diagram of the setting mechanism at a refiner with a single cylinder. It comprises an axially movable wedge carrier 1 and a radially movable wedge carrier 2 on which a refiner plate 5 is mounted. The counter refiner plate 5' is mounted on the rotor 4. The energy from the setting mechanism is transferred along an inclined plane defined by the surface of the inclined face of wedge carrier 1 and the inclined face of wedge carrier 2 which are engaged at the inclined plane. If the wedge carrier 1 is now displaced axially, this results in radial displacement of the wedge carrier 2 due to the transfer of energy at the wedge. As a result, the gap 3 between the refiner plates 5 and 5' can be set precisely.

Figure 2:
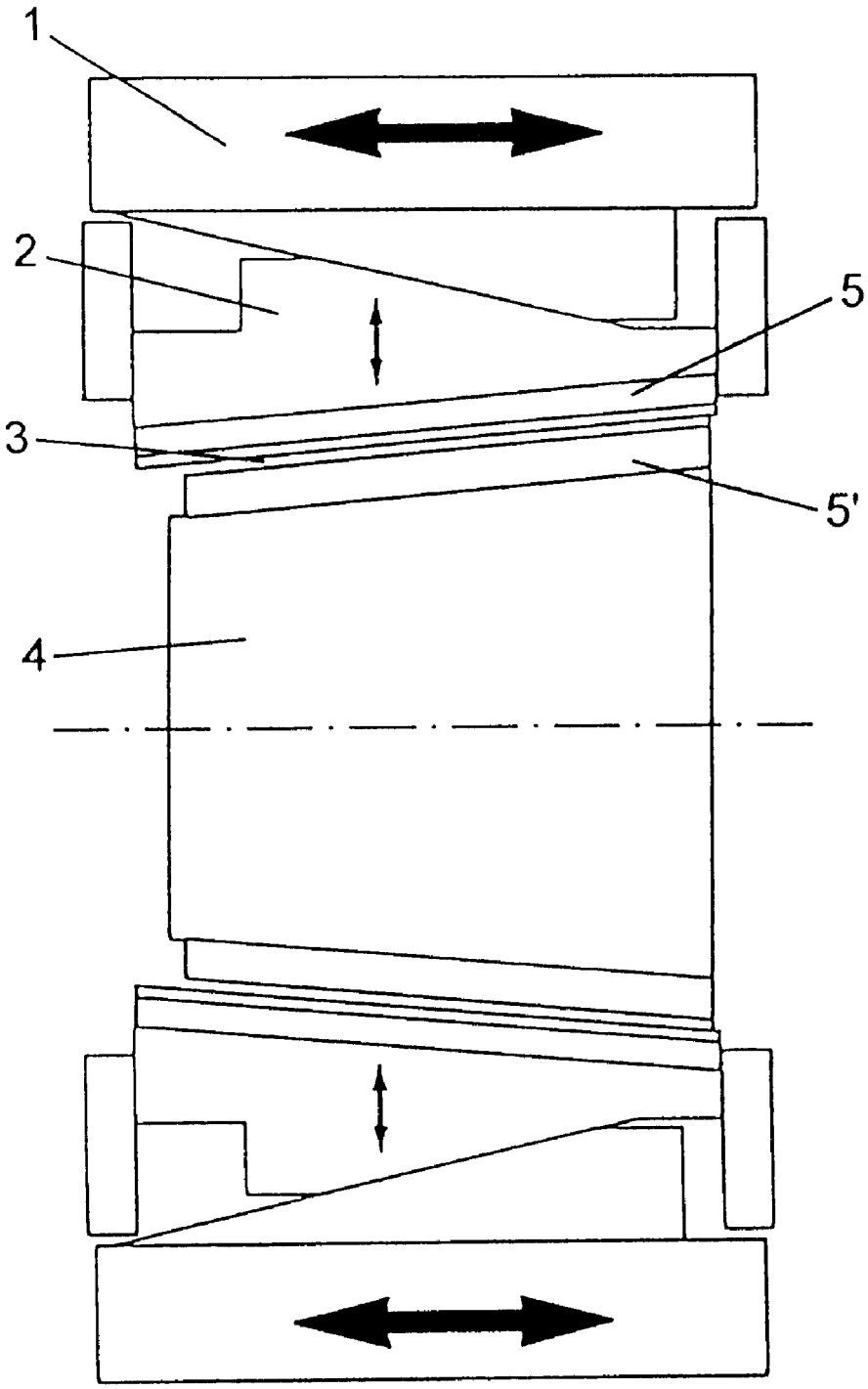
FIG. 2 is a schematic view of a second embodiment of the refiner of the invention.

FIG. 2 shows an analogous variant, but the rotor 4 here is of conical design. As a result, the refiner plates 5 and 5' are also designed as parts of a cone.

Figure 3:
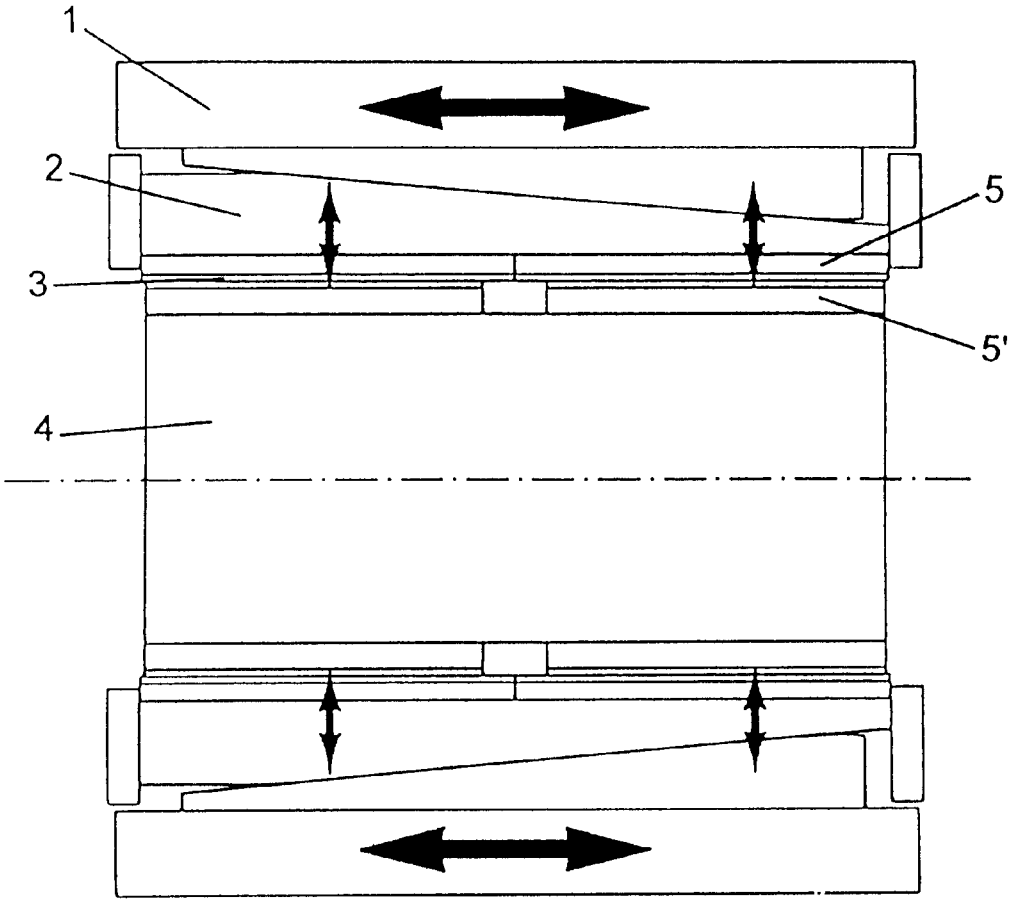
FIG. 3 is a schematic view of a third embodiment of the refiner of the invention.

FIG. 3 now shows a variant with a twin cylinder refiner. Here, too the axial displacement of the wedge carrier 1 exerts force on the wedge carrier 1 which is displaced in radial direction as a result. In this case, it also sets the gap 3 between the refiner plates 5 of the stator and the refiner plates 5' of the rotor. The refining gap in operations is between 0 and 2 mm, for example 0.5 mm. If larger impurities occur or also in the start-up phase of the machine, the gap can be opened to up to 16 mm.

Figure 4:
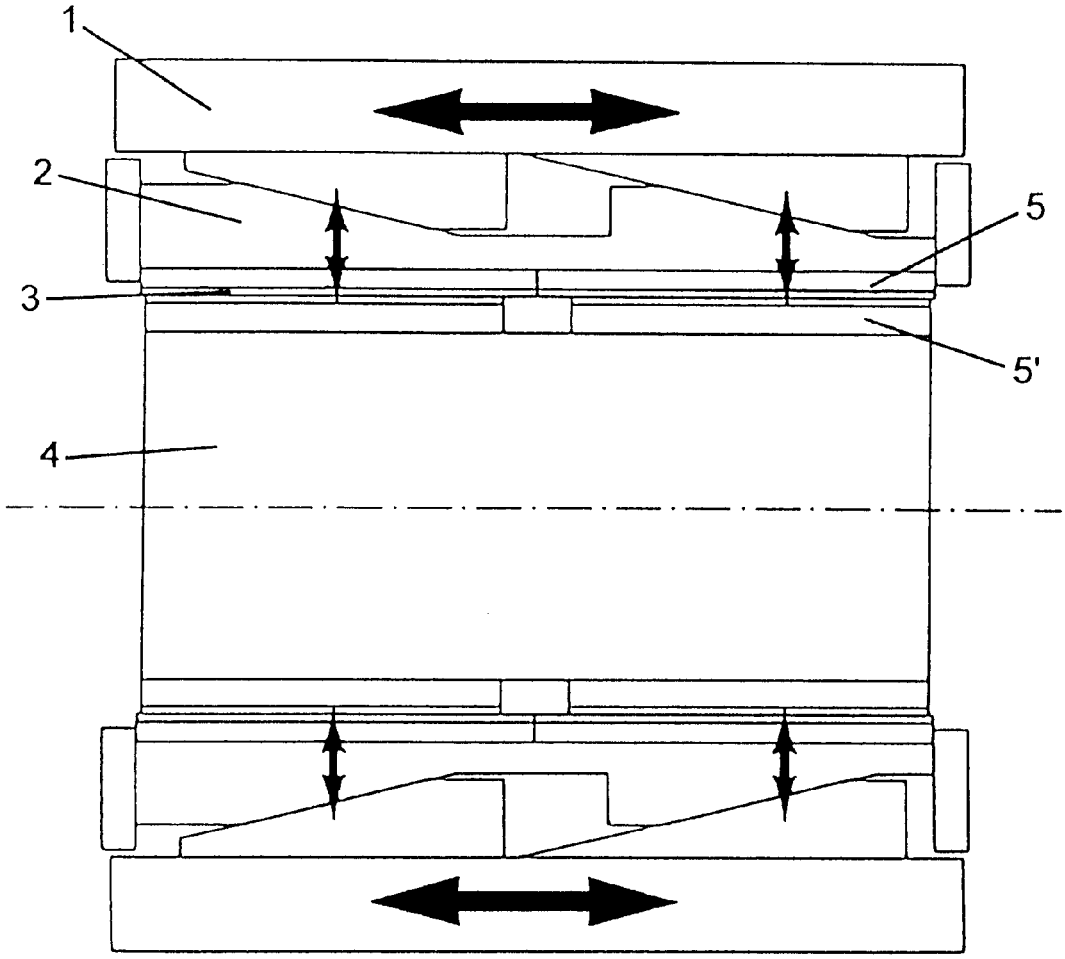
FIG. 4 is a schematic view of a fourth embodiment of the refiner of the invention.

FIG. 4 shows a further variant of the setting at a twin cylinder refiner. Instead of a single long wedge, there are two shorter wedge segments mounted on the wedge carrier 1, each of which are approximately the same length as one of the cylindrical refining surfaces 5'. The wedge carrier 2 as counterpart beside these two cylindrical refining surfaces 5' has inclined planes along which the wedge carrier 1 slides. It functions in the same way as in the preceding variants, where displacement of the wedge carrier 1 in axial direction in turn causes displacement of the wedge carrier 2 in radial direction. Since this movement is distributed between two wedge segment surfaces, this permits better and more even transfer of energy and thus, much more exact setting of the refining gap 3 between the refiner plates 5 and 5'.

Figure 5:
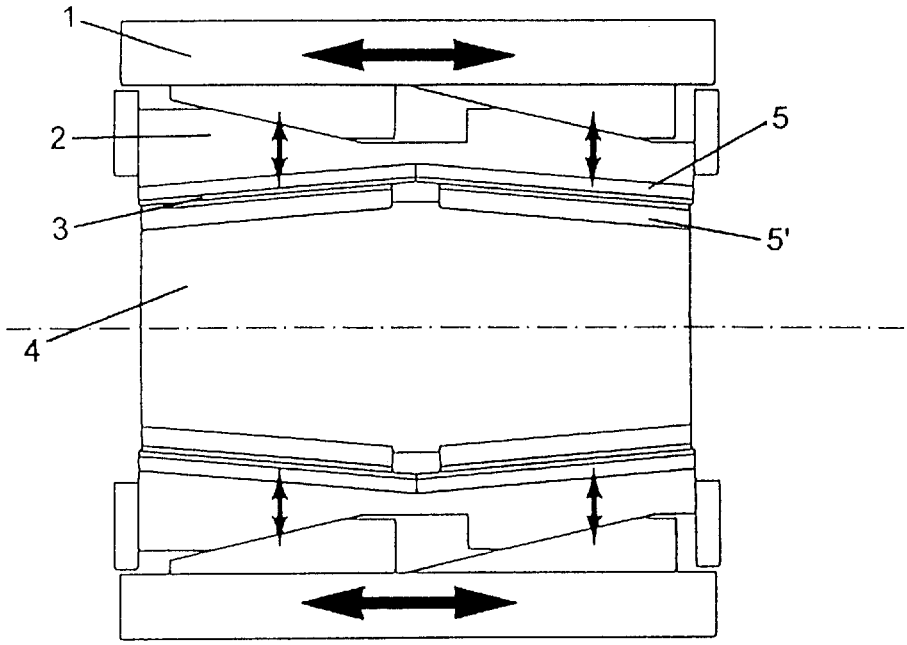
FIG. 5 is a schematic view of a fifth embodiment of the refiner of the invention.
Figure 6:
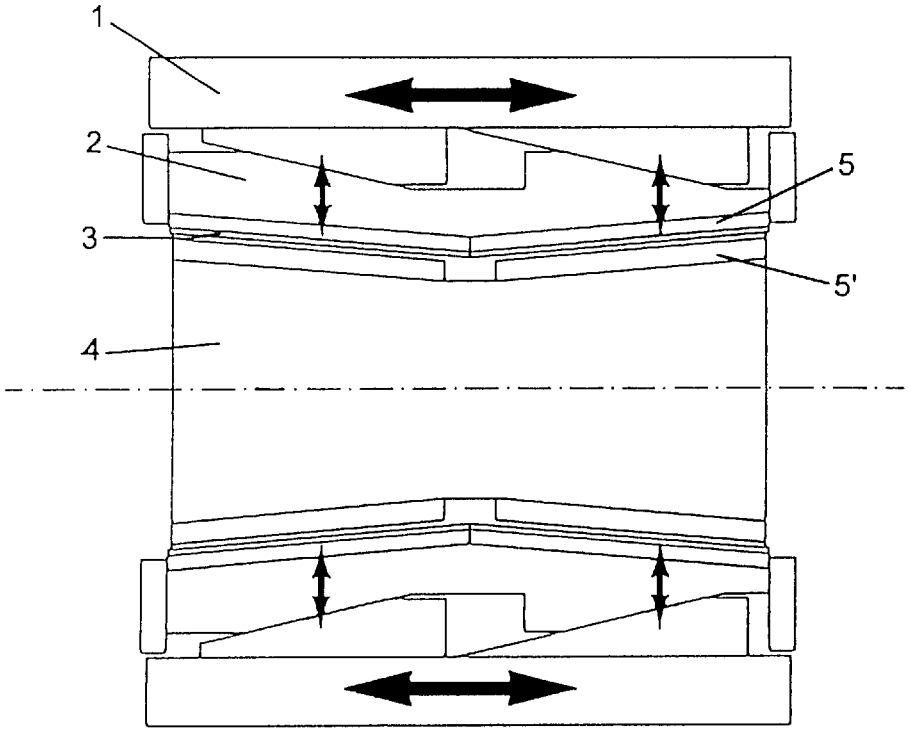
FIG. 6 is a schematic view of a sixth embodiment of the refiner of the invention.

FIGS. 5 and 6 show analogous configurations, with a conical rotor narrowing from the center outwards in FIG. 5 and a conical rotor widening from the center outwards in FIG. 6.

Figure 7:
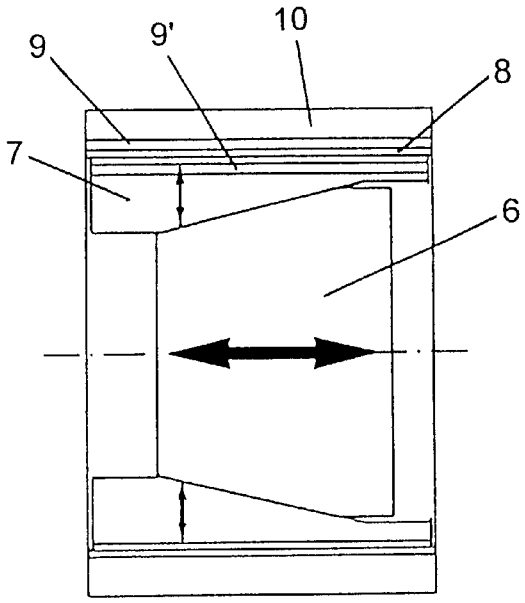
FIG. 7 is a schematic view of a seventh embodiment of the refiner of the invention.

FIG. 7 shows a variant where the two wedge carriers converging on inclined planes are held together in the rotor. Here an axially movable wedge carrier 6 is provided that acts on a wedge carrier 7 which can be adjusted in radial direction and carries the refiner plates 9' on the rotor. The stator 10 with the counter refiner plates 9 remains constant in this case, with the refining gap 8 being set between the refiner plates 9 and 9'.

Figure 8:
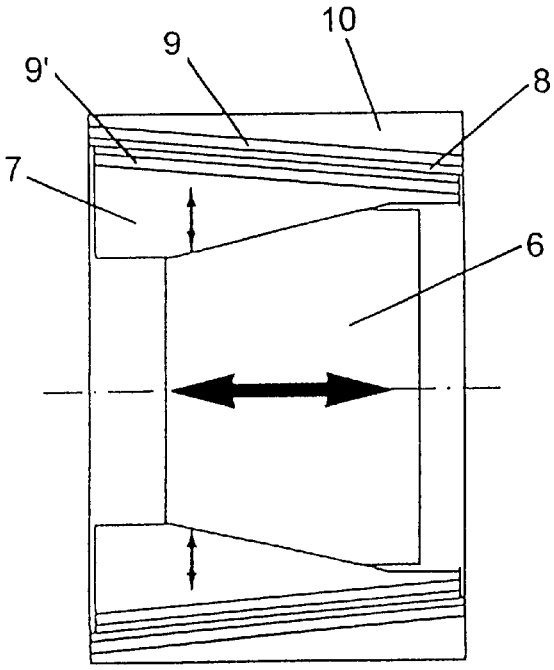
FIG. 8 is a schematic view of an eighth embodiment of the refiner of the invention.

FIG. 8 shows another variant of the configuration according to FIG. 7, where the refiner plates 9 and 9' form a conical refining gap 8.

Figure 9:
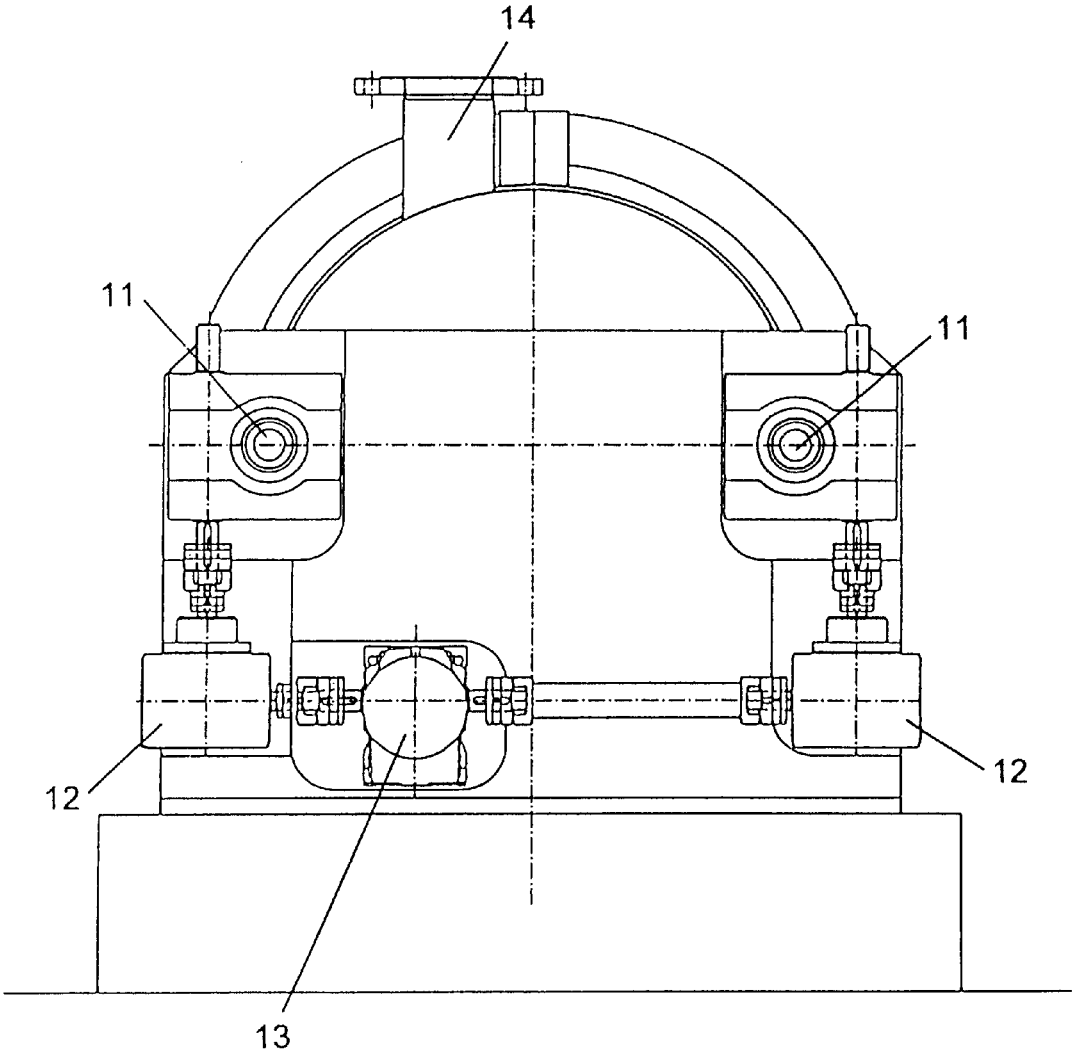
FIG. 9 a side view of the refiner of FIG. 1.

FIG. 9 shows a view of a refiner according to the invention, where two sliding bolts 11 are shown, which help to move the wedge carrier 1 axially. The sliding bolts 11 are driven by a motor 13 from which the power is transferred by gears 12. Due to these gears 12, even adjustment of the sliding bolts 11 is also achieved. In addition, this illustration shows the feed 14 for the pulp suspension.

Figure 10:
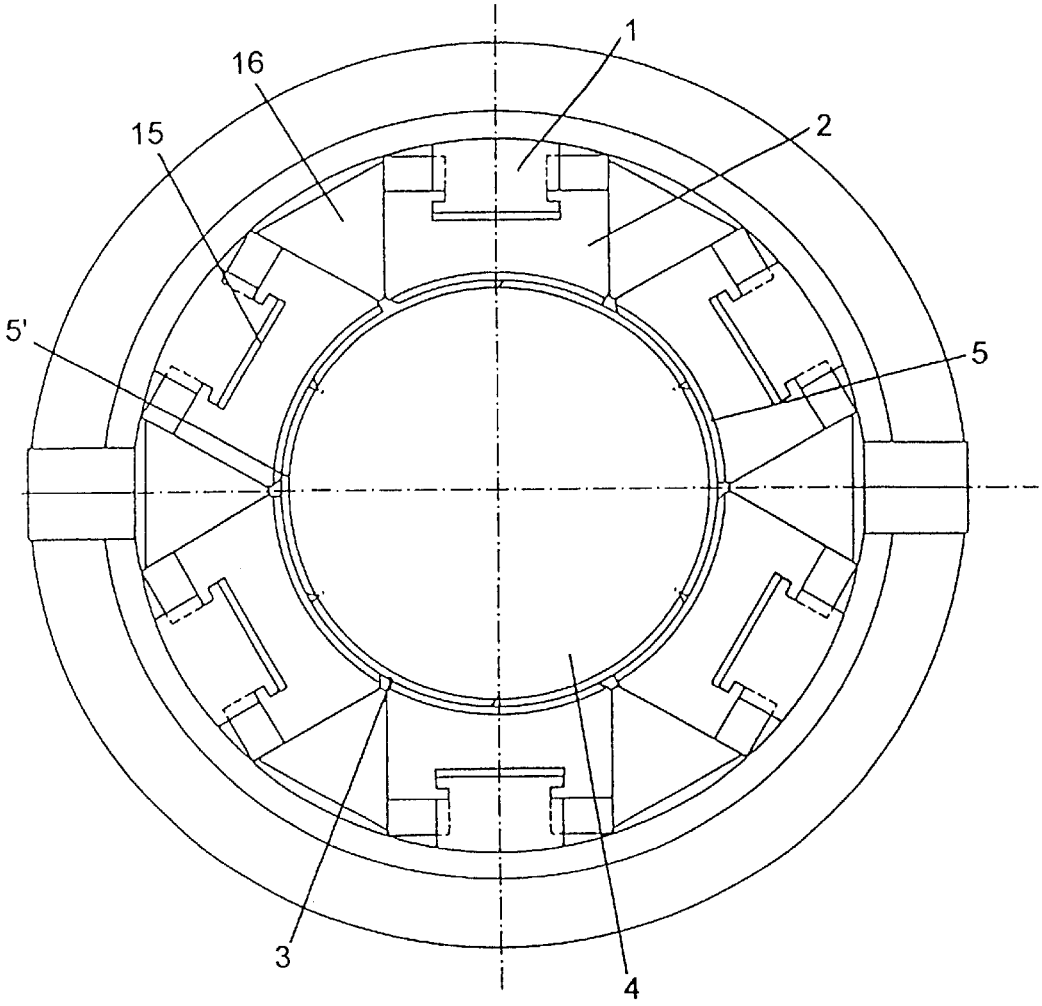
FIG. 10 a cross section view of the rotor of FIG. 1.

FIG. 10 contains a possible section through a rotor. The illustration shows the axially movable wedge carrier 1, the radially movable wedge carrier 2, the refining gap 3 formed by the refiner plates 5 and 5', and the rotor 4. The radially movable wedge carrier 2 slides here along the inclined plane 15 between wedge carrier 1 and wedge carrier 2 and is displaced radially along the edges of the triangular mountings 16.

Figure 11:
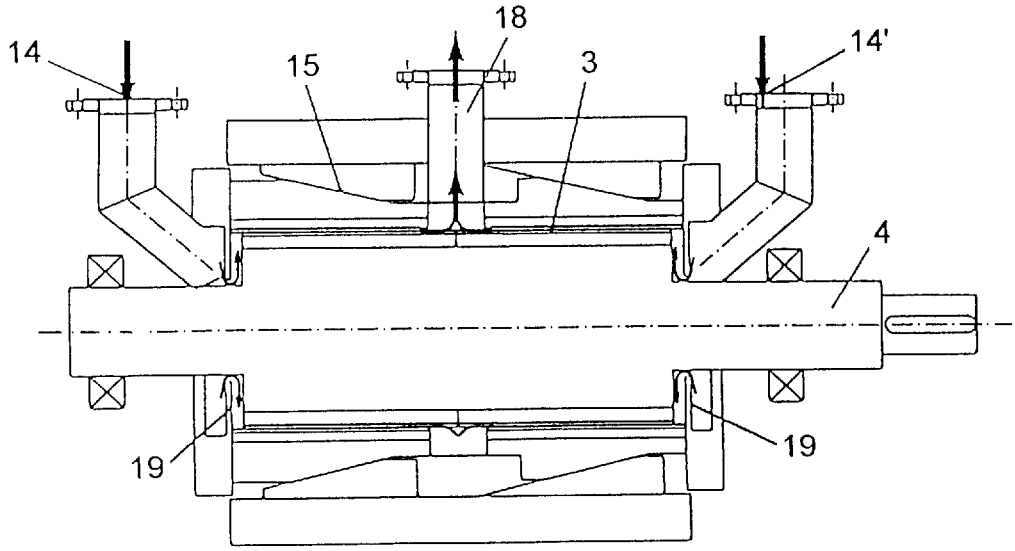
FIG. 11 is a schematic view of the refiner of the invention having a central stock discharge.

FIG. 11 shows a possible pulp feed variant to a twin cylinder refiner where the pulp is fed in through connections 14 and 14 and discharged again at the center through connection 18. The pulp is deflected on both sides to the pulp feed channel by a disc 19 and further into the refining gap 3. The same pulp routing is also possible with a twin cone which can be designed as a widening or a narrowing cone from the outer inlet to the center outlet.

Figure 12:
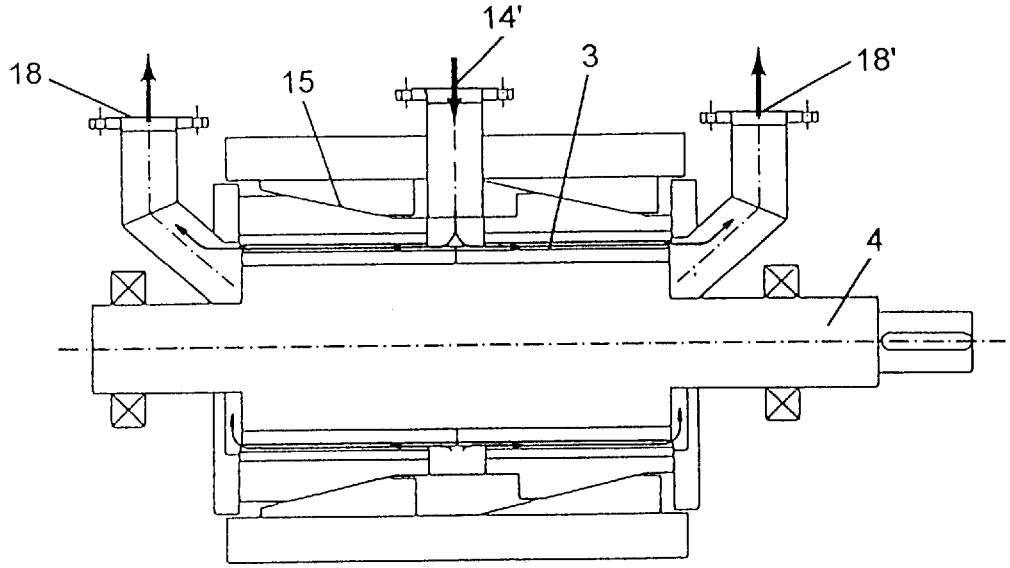
FIG. 12 is a schematic view of the refiner of the invention having a central stock feed.

FIG. 12 shows a possible pulp feed variant to a twin cylinder refiner with the refining gap setting according to the invention where the pulp is fed in centrally through pulp feed 14 and discharged again at both ends of the refiner through the outlets 18 and 18'. This illustration shows the variant according to FIG. 4 however the variant according to FIG. 3 can also be used.

Figure 13:
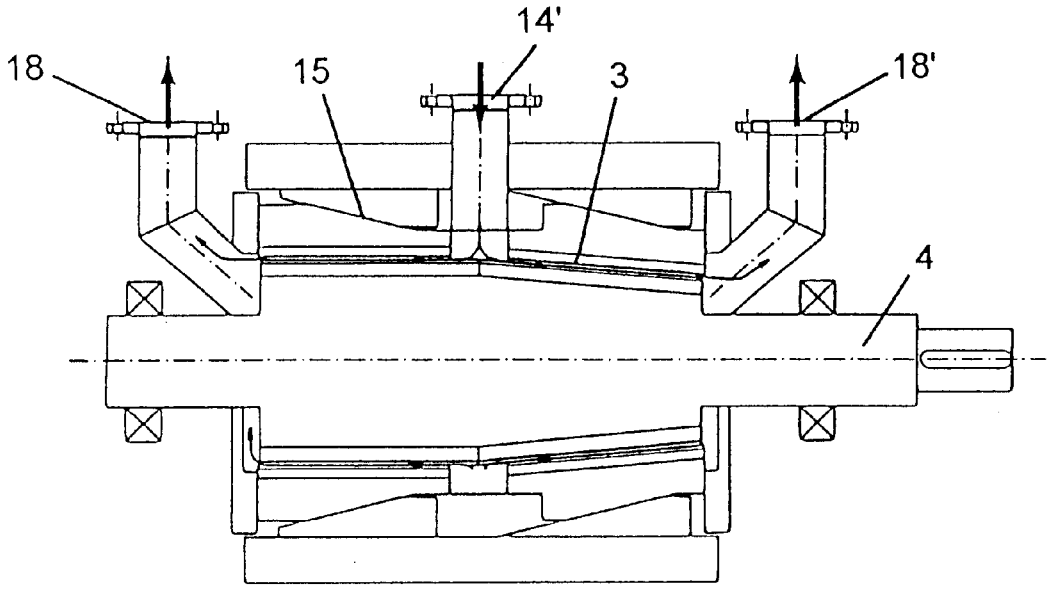
FIG. 13 is an alternate embodiment of the refiner of FIG. 12.

FIG. 13 now shows a further variant using a combination of cylindrical and conical refining zones. The remaining elements correspond to those described under FIG. 12.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A refiner for shredding pulps comprising:

a rotor having a refining surface;

a stator having a refining surface; and first and second wedges, each of the wedges having an inclined surface, the first wedge being carried on an axially movable wedge carrier, the second wedge being carried on a radially movable wedge carrier, the inclined surface of the first wedge slidably engaging the inclined surface of the second wedge;

wherein the refining surfaces of the rotor and stator define a refining gap and the first wedge is moveable against the second wedge to set the refining gap.

2. Refiner according to claim 1, wherein the refining gap is continuously adjustable between 0 and 2 mm.

3. Refiner according to claim 1, wherein the refining gap may be set at up to 15 mm.

4. Refiner according to claim 1, wherein the relative speed at the periphery is 15–35 m/see.

5. Refiner according to claim 1, wherein the rotor speed is between 400 and 1,800 rpm.

6. Refiner according to claim 1, wherein the radially movable wedge carrier is divided into segments of a circle.

7. Refiner according to claim 1, wherein the refining gap is continuously adjustable between 0 and 1 mm.

8. Refiner according to claim 1, wherein the refining gap is continuously adjustable between 0 and 0.5 mm.

9. Refiner according to claim 1, wherein the relative speed at the periphery is 20 to 30 m/sec.

10. Refiner according to claim 1, wherein the rotor speed is between 500 and 1,000 rpm.

11. A refiner for shredding pulps comprising:

a twin rotor having a refining surface;

a stator having a refining surface; and first and second wedges, the first wedge being carried on an axially movable wedge carrier, and the second wedge being carried on a radially movable wedge carrier, the first wedge comprising two wedge segments, each of the wedge segments having an inclined surface which slidingly engage the inclined surface of the second wedge;

wherein the refining surfaces of the rotor and stator define a refining gap and the first wedge is moveable against the second wedge to set the refining gap.

* * * * *